US011651745B2

(12) United States Patent
Chen et al.

(10) Patent No.: US 11,651,745 B2
(45) Date of Patent: May 16, 2023

(54) BACKLIGHT DRIVING METHOD AND DEVICE FOR DRIVING A SCAN-TYPE DISPLAY

(71) Applicant: MACROBLOCK, INC., Hsinchu (TW)

(72) Inventors: Chang-Lin Chen, Hsinchu (TW); Chun-Yi Li, Hsinchu (TW); Wei-Chung Chen, Hsinchu (TW)

(73) Assignee: MACROBLOCK, INC., Hsinchu (TW)

( * ) Notice: Subject to any disclaimer, the term of this patent is extended or adjusted under 35 U.S.C. 154(b) by 0 days.

(21) Appl. No.: 17/662,713

(22) Filed: May 10, 2022

(65) Prior Publication Data

US 2022/0366862 A1 Nov. 17, 2022

(30) Foreign Application Priority Data

May 13, 2021 (TW) ..... 110117348

(51) Int. Cl.
*G09G 3/34* (2006.01)

(52) U.S. Cl.
CPC ..... *G09G 3/3426* (2013.01); *G09G 2310/08* (2013.01)

(58) Field of Classification Search
None
See application file for complete search history.

(56) References Cited

U.S. PATENT DOCUMENTS

2008/0094344 A1* 4/2008 Kuroki ..... G09G 3/342 345/102
2010/0110097 A1* 5/2010 Nam ..... H05B 45/10 345/589

* cited by examiner

*Primary Examiner* — Matthew Yeung
(74) *Attorney, Agent, or Firm* — Akerman LLP; Peter A. Chiabotti

(57) ABSTRACT

A backlight driving method includes steps of: (A) receiving a piece of image data; (B) generating a piece of adjustment data based on the image data; (C) generating, based on a plurality of predetermined delay values and on an original synchronization control (SC) signal that has a pulse, an internal SC signal that has a plurality of pulses, where respective time delays of the pulses of the internal SC signal with respect to the pulse of the original SC signal are respectively dependent on the predetermined delay values; and (D) generating a backlight driving output based on the adjustment data and the internal SC signal, so as to drive a backlight source of a scan-type display to emit light intermittently.

8 Claims, 3 Drawing Sheets

BACKLIGHT DRIVING METHOD AND DEVICE FOR DRIVING A SCAN-TYPE DISPLAY

CROSS-REFERENCE TO RELATED APPLICATION

This application claims priority of Taiwanese Patent Application No. 110117348, filed on May 13, 2021.

FIELD

The disclosure relates to display driving techniques, and more particularly to a backlight driving method and a backlight driving device for driving a scan-type display.

BACKGROUND

In a liquid crystal display, light emitted by a backlight source passes through a liquid crystal layer of a liquid crystal panel by a variable amount, and is filtered by a color filter of the liquid crystal panel, so as to produce color images. The liquid crystal layer has a long response time. If all light emitting diodes (LEDs) of the backlight source emit light continuously, motion blur could occur when the liquid crystal display shows moving images.

SUMMARY

Therefore, an object of the disclosure is to provide a backlight driving method and a backlight driving device for driving a scan-type display. The backlight driving method and the backlight driving device can alleviate motion blur.

According to an aspect of the disclosure, the backlight driving method is to be implemented by a backlight driving device, and is adapted to drive a backlight source of a scan-type display. The backlight source includes a plurality of light emitting elements, and is divided into a plurality of areas. The backlight driving method includes steps of: (A) receiving a piece of image data that is related to an image frame to be shown by the scan-type display; (B) generating a piece of adjustment data based on the image data; (C) generating an internal synchronization control signal based on an original synchronization control signal and a plurality of predetermined delay values; the original synchronization control signal having a pulse that is related to refreshing of image frames on the scan-type display, and that corresponds to the adjustment data in time; the internal synchronization control signal having a plurality of pulses that correspond to the adjustment data in time; a time delay of each of the pulses of the internal synchronization control signal with respect to the pulse of the original synchronization control signal being dependent on a respective one of the predetermined delay values; and (D) generating a backlight driving output based on the adjustment data and the internal synchronization control signal and outputting the backlight driving output to the backlight source, such that each of the light emitting elements of the backlight source emits light intermittently, and brightness of each of the areas of the backlight source changes to be dependent on the adjustment data upon appearance of a respective one of the pulses of the internal synchronization control signal.

According to another aspect of the disclosure, the backlight driving device is adapted to drive a backlight source of a scan-type display. The backlight source includes a plurality of light emitting elements, and is divided into a plurality of areas. The backlight driving device includes a controller and a backlight driver. The controller is to receive a piece of image data that is related to an image frame to be shown by the scan-type display, generates a piece of adjustment data based on the image data, and further generates an original synchronization control signal and a plurality of predetermined delay values. The original synchronization control signal has a pulse that is related to refreshing of image frames on the scan-type display, and that corresponds to the adjustment data in time. The backlight driver is coupled to the controller to receive the adjustment data, the original synchronization control signal and the predetermined delay values, and is adapted to be further coupled to the backlight source. The backlight driver generates an internal synchronization control signal based on the original synchronization control signal and the predetermined delay values. The internal synchronization control signal has a plurality of pulses that correspond to the adjustment data in time. A time delay of each of the pulses of the internal synchronization control signal with respect to the pulse of the original synchronization control signal is dependent on a respective one of the predetermined delay values. The backlight driver further generates a backlight driving output based on the adjustment data and the internal synchronization control signal and outputs the backlight driving output to the backlight source, such that each of the light emitting elements of the backlight source emits light intermittently, and brightness of each of the areas of the backlight source changes to be dependent on the adjustment data upon appearance of a respective one of the pulses of the internal synchronization control signal.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
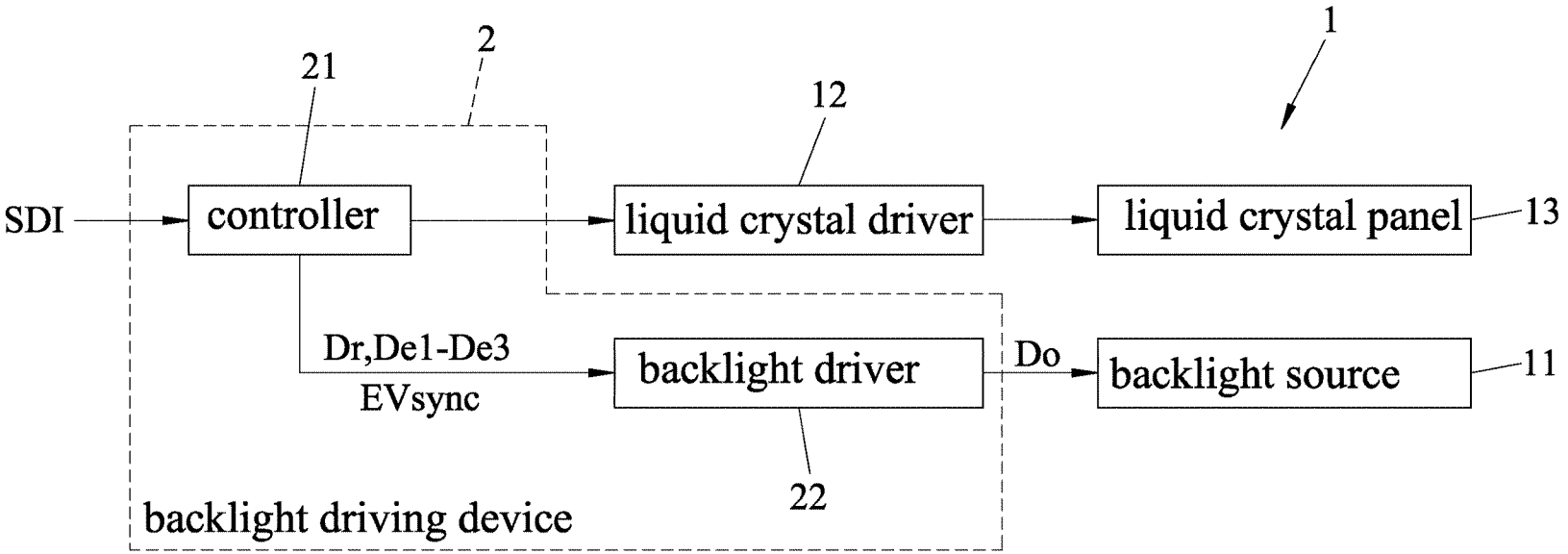
FIG. 1 is a block diagram illustrating an embodiment of a backlight driving device according to the disclosure.

Referring to FIG. 1, an embodiment of a backlight driving device 2 according to the disclosure is operatively associated with a scan-type display 1. In this embodiment, the scan-type display 1 is a liquid crystal display, supports dynamic frame rate technologies, and includes a backlight source 11, a liquid crystal driver 12, and a liquid crystal panel 13 that is coupled to the liquid crystal driver 12. The backlight driving device 2 of this embodiment performs a backlight driving method, so as to drive the backlight source 11 to emit light.

The backlight source 11 includes a plurality of switches (not shown), and a light emitting array (e.g., a light emitting diode (LED) array) (not shown) that includes a plurality of light emitting elements (e.g., a plurality of LEDs). The configuration of the backlight source 11 is known to those skilled in the art, and other details thereof are omitted herein for the sake of brevity. In this embodiment, the backlight source 11 is divided into a number (K) of areas (not shown), each of which includes some of the light emitting elements, where K is an integer no less than two. For illustration purposes, K=3 in this embodiment.

In this embodiment, the backlight driving device 2 includes a controller 21 and a backlight driver 22. The controller 21 is adapted to be coupled to the liquid crystal driver 12. The backlight driver 22 is coupled to the controller 21, and is adapted to be further coupled to the backlight source 11.

The controller 21 is to receive a serial input signal (SDI) that contains an image stream. The image stream contains multiple pieces of image data that are sequentially arranged in time. Each piece of image data is related to a respective image frame (an image of one frame of the image stream) to be shown by the scan-type display 1, and is used to determine light transmittance of the liquid crystal panel 13. To be specific, the controller 21 sequentially receives the pieces of image data, and sequentially outputs the pieces of image data to the liquid crystal driver 12; and the liquid crystal driver 12 sequentially controls the light transmittance of the liquid crystal panel 13 based on the pieces of image data, so that light emitted by the backlight source 11 is modulated by the liquid crystal panel 13 to sequentially produce the image frames respectively relating to the pieces of image data. The aforesaid operations are known to those skilled in the art, and details thereof are omitted herein for the sake of brevity.

Figure 2:
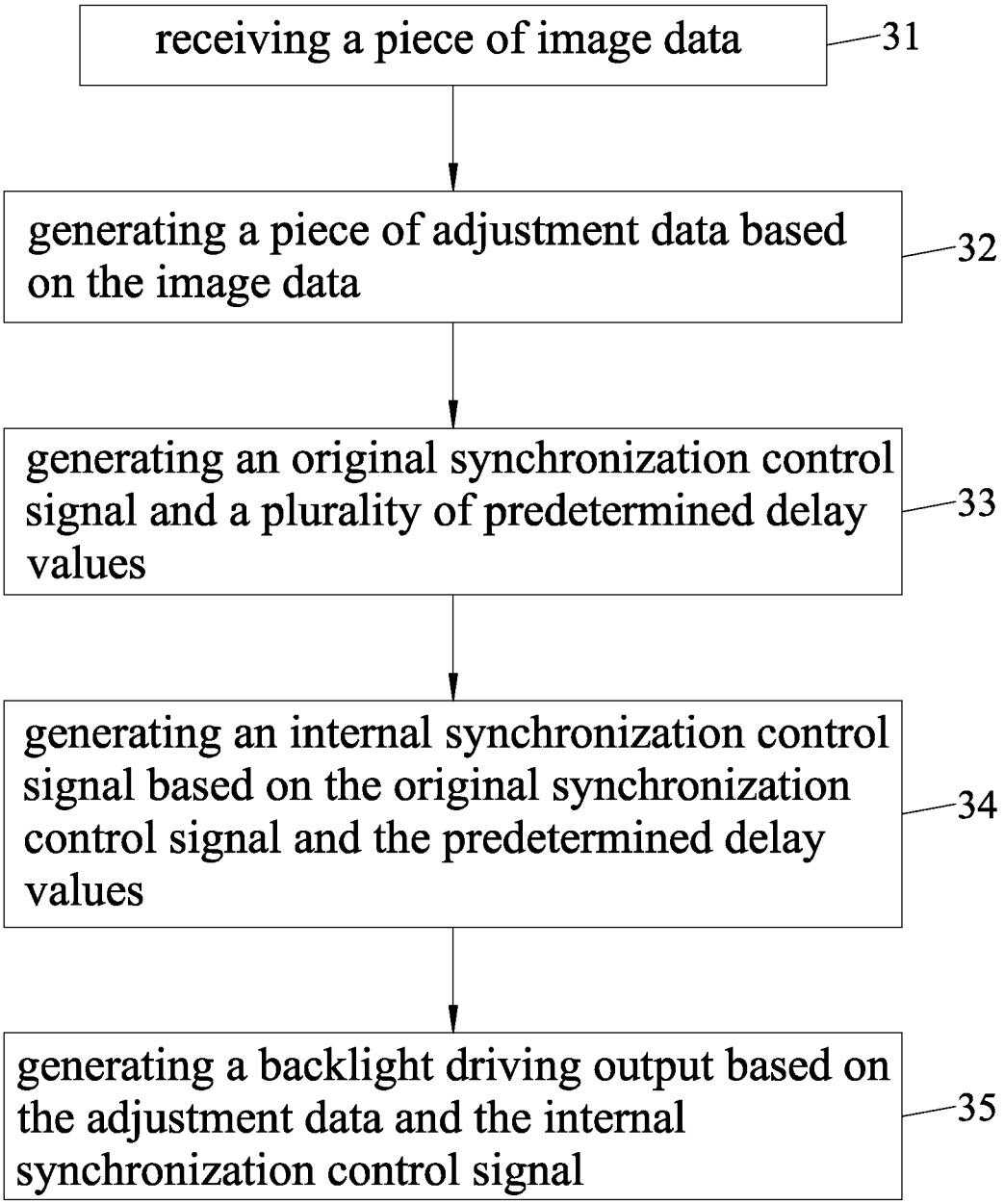
FIG. 2 is a flow chart illustrating a backlight driving method performed by the embodiment.
Figure 3:
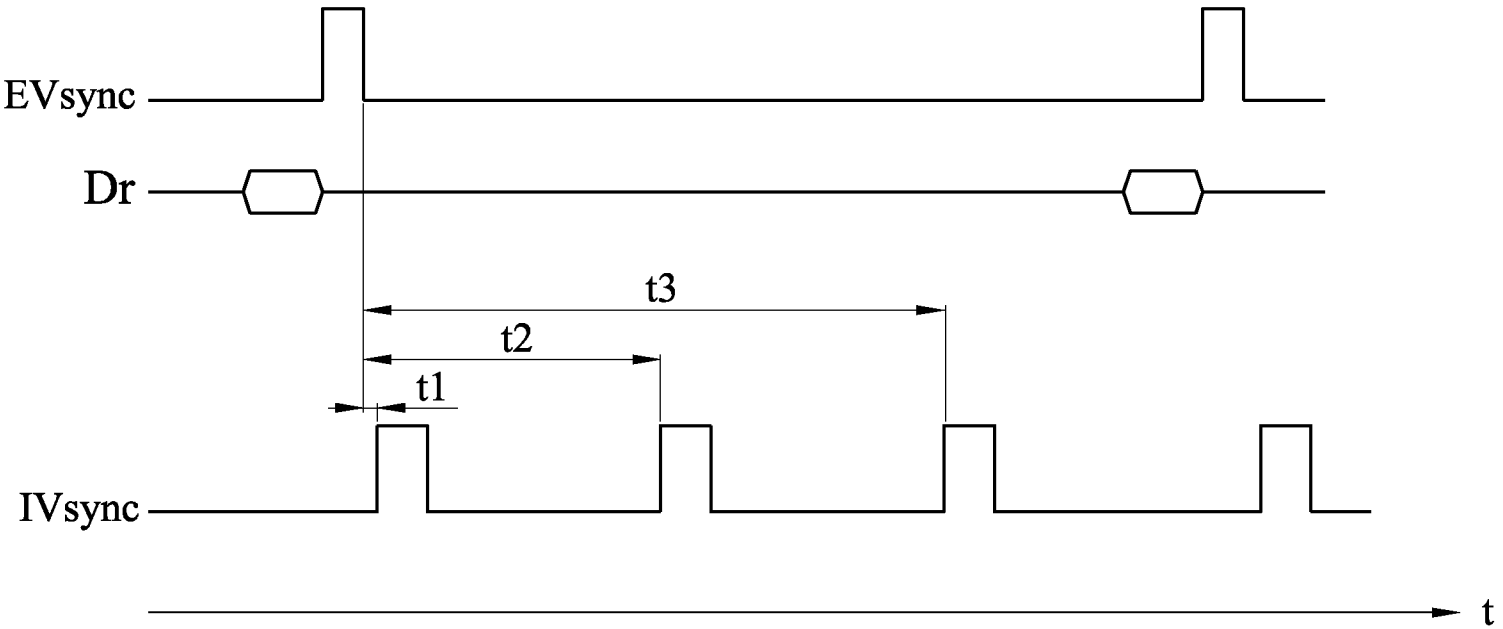
FIG. 3 is a timing diagram illustrating an original synchronization control signal, adjustment data and an internal synchronization control signal of the embodiment.

Referring to FIGS. 1, 2 and 3, in this embodiment, with respect to each piece of image data, the backlight driving device 2 performs the backlight driving method that includes steps 31-35 once, so as to drive the backlight source 11 to emit light.

In step 31, the controller 21 receives the piece of image data.

In step 32, the controller 21 generates a piece of adjustment data (Dr) based on the piece of image data, and outputs the piece of adjustment data (Dr).

In step 33, the controller 21 generates an original synchronization control signal (EVsync) and a number (K) of predetermined delay values (three predetermined delay values (De1-De3) in this embodiment) based on timing of the generation and output of the piece of adjustment data (Dr), and outputs the original synchronization control signal (EVsync) and the predetermined delay values (De1-De3).

The original synchronization control signal (EVsync) has a pulse that is related to refreshing of image frames on the scan-type display 1 (i.e., an act of the scan-type display 1 switching from displaying a current image frame to displaying a next image frame), and that corresponds to the piece of adjustment data (Dr) in time.

In step 34, the backlight driver 22 receives the piece of adjustment data (Dr), the original synchronization control signal (EVsync) and the predetermined delay values (De1-De3) from the controller 21, and generates an internal synchronization control signal (IVsync) based on the original synchronization control signal (EVsync) and the predetermined delay values (De1-De3).

The internal synchronization control signal (IVsync) has a number (K) of pulses (three pulses in this embodiment) that correspond to the piece of adjustment data (Dr) in time. A time delay of each of the pulses of the internal synchronization control signal (IVsync) with respect to the pulse of the original synchronization control signal (EVsync) is dependent on a respective one of the predetermined delay values (De1-De3).

To be specific, as shown in FIG. 3, the pulse of the original synchronization control signal (EVsync) appears after the piece of adjustment data (Dr) is generated and outputted, and before a next piece of adjustment data (Dr) is generated and outputted; the pulses of the internal synchronization control signal (IVsync) appear after the piece of adjustment data (Dr) is generated and outputted, and before the next piece of adjustment data (Dr) is generated and outputted; and a time interval (ti) between the pulse of the original synchronization control signal (EVsync) and an $i^{th}$ one of the pulses of the internal synchronization control signal (IVsync) is determined by an $i^{th}$ one of the predetermined delay values (Dei) (e.g., being equal to a product of the $i^{th}$ one of the predetermined delay values (Dei) and a predetermined time length), where $1 \le i \le K$ ($1 \le i \le 3$ in this embodiment). It should be noted that, in this embodiment, the predetermined delay values (De1-De3) form an arithmetic progression with a positive common difference, so a difference between the time intervals (t1, t2) is equal to a difference between the time intervals (t2, t3). However, in another embodiment, the predetermined delay values (De1-De3) form a strictly monotonically increasing sequence, and differences between each two adjacent ones of the predetermined delay values (De1-De3) are different from one another, so the difference between the time intervals (t1, t2) is different from the difference between the time intervals (t2, t3). Moreover, in yet another embodiment, a first one of the predetermined delay values (De1) is zero, so the time interval (t1) is zero.

In step 35, the backlight driver 22 generates a backlight driving output (Do) based on the piece of adjustment data (Dr) and the internal synchronization control signal (IVsync) and outputs the backlight driving output (Do) to the backlight source 11, such that each of the light emitting elements of the light emitting array of the backlight source 11 emits light intermittently, and brightness of each of the areas of the backlight source 11 changes to be dependent on the piece of adjustment data (Dr) upon appearance of a respective one of the pulses of the internal synchronization control signal (IVsync).

For example, the light emitting elements of the light emitting array of the backlight source 11 are arranged in a matrix that has nine rows and five columns, the first to third rows of the light emitting array of the backlight source 11 belong to a first one of the areas of the backlight source 11, the fourth to sixth rows of the light emitting array of the backlight source 11 belong to a second one of the areas of the backlight source 11, and the seventh to ninth rows of the light emitting array of the backlight source 11 belong to a third one of the areas of the backlight source 11. With respect to each piece of image data, when the liquid crystal driver 12 controls the light transmittance of the liquid crystal panel 13 based on the piece of image data, the backlight driving device 2 of this embodiment operates as follows. Upon appearance of a first one of the pulses of the internal synchronization control signal (IVsync), the backlight driver 22 generates the backlight driving output (Do) based on the piece of adjustment data (Dr) that originates from the piece of image data to drive the backlight source 11, such that the first to ninth rows of the light emitting array of the backlight source 11 emit light one by one without overlapping one another in time (i.e., the backlight source 11 emits light in a line scan manner), the brightness of the first one of the areas of the backlight source 11 (including respective brightnesses of the first to third rows of the light emitting array of the backlight source 11) becomes dependent on the piece of adjustment data (Dr) that originates from the piece of image data, and the brightness of the second one of the areas of the backlight source 11 (including respective brightnesses of the fourth to sixth rows of the light emitting array of the backlight source 11) and the brightness of the third one of the areas of the backlight source 11 (including respective brightnesses of the seventh to ninth rows of the light emitting array of the backlight source 11) remain unchanged. Upon appearance of a second one of the pulses of the internal synchronization control signal (IVsync), the backlight driver 22 generates the backlight driving output (Do) based on the piece of adjustment data (Dr) that originates from the piece of image data to drive the backlight source 11, such that the first to ninth rows of the light emitting array of the backlight source 11 emit light one by one without overlapping one another in time, the brightness of the second one of the areas of the backlight source 11 becomes dependent on the piece of adjustment data (Dr) that originates from the piece of image data, and the respective brightnesses of the first and third ones of the areas of the backlight source 11 remain unchanged. Upon appearance of a third one of the pulses of the internal synchronization control signal (IVsync), the backlight driver 22 generates the backlight driving output (Do) based on the piece of adjustment data (Dr) that originates from the piece of image data to drive the backlight source 11, such that the first to ninth rows of the light emitting array of the backlight source 11 emit light one by one without overlapping one another in time, the brightness of the third one of the areas of the backlight source 11 becomes dependent on the piece of adjustment data (Dr) that originates from the piece of image data, and the respective brightnesses of the first and second ones of the areas of the backlight source 11 remain unchanged.

In view of the above, in this embodiment, by virtue of the backlight driving device 2 performing the backlight driving method, each of the light emitting elements of the light emitting array of the backlight source 11 emits light intermittently instead of continuously, thereby alleviating motion blur and enhancing display quality when the liquid crystal display 1 shows moving images.

It should be noted that, in another embodiment, with respect to each piece of image data, the backlight driver 22 may generate the backlight driving output (Do) in such a way that the backlight source 11 starts to emit light in the line scan manner upon appearance of the first one of the pulses of the internal synchronization control signal (IVsync), and stops emitting light at an end of a predetermined time period counting from a time point at which the third one of the pulses of the internal synchronization control signal (IVsync) appears, thereby further alleviating motion blur and enhancing display quality when the liquid crystal display 1 shows moving images. In yet another embodiment, with respect to each piece of image data, the backlight driver 22 may generate the backlight driving output (Do) in such a way that the backlight source 11 starts to emit light in the line scan manner for a predetermined time period upon appearance of any one of the pulses of the internal synchronization control signal (IVsync), thereby further alleviating motion blur and enhancing display quality when the liquid crystal display 1 shows moving images.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that the disclosure is not limited to the disclosed embodiment but is intended to cover various arrangements included within the spirit and scope of the broadest interpretation so as to encompass all such modifications and equivalent arrangements.

What is claimed is:

1. A backlight driving method to be implemented by a backlight driving device, and adapted to drive a backlight source of a scan-type display; the backlight source including a plurality of light emitting elements, and being divided into a plurality of areas; said backlight driving method comprising steps of:

(A) receiving a piece of image data that is related to an image frame to be shown by the scan-type display;

(B) generating a piece of adjustment data based on the image data;

(C) generating an internal synchronization control signal based on an original synchronization control signal and a plurality of predetermined delay values; the original synchronization control signal having a pulse that is related to refreshing of image frames on the scan-type display, and that corresponds to the adjustment data in time; the internal synchronization control signal having a plurality of pulses that correspond to the adjustment data in time; a time delay of each of the pulses of the internal synchronization control signal with respect to the pulse of the original synchronization control signal being dependent on a respective one of the predetermined delay values;

(D) generating a backlight driving output based on the adjustment data and the internal synchronization control signal and outputting the backlight driving output to the backlight source, such that each of the light emitting elements of the backlight source emits light intermittently, and brightness of each of the areas of the backlight source changes to be dependent on the adjustment data upon appearance of a respective one of the pulses of the internal synchronization control signal;

wherein the pulse of the original synchronization control signal appears after the adjustment data is generated; and wherein a time interval between the pulse of the original synchronization control signal and each of the pulses of the internal synchronization control signal is determined by the respective one of the predetermined delay values.

2. The backlight driving method of claim 1, wherein:

a total number of the predetermined delay values is no less than two; and the predetermined delay values form an arithmetic progression with a positive common difference.

3. The backlight driving method of claim 1, wherein:

a total number of the predetermined delay values is no less than two;

the predetermined delay values form a strictly monotonically increasing sequence; and differences, between each two adjacent ones of the predetermined delay values, are different from one another.

4. The backlight driving method of claim 1, wherein a first one of the predetermined delay values is zero.

5. A backlight driving device adapted to drive a backlight source of a scan-type display; the backlight source including a plurality of light emitting elements, and being divided into a plurality of areas; said backlight driving device comprising:

a controller to receive a piece of image data that is related to an image frame to be shown by the scan-type display, generating a piece of adjustment data based on the image data, and further generating an original synchronization control signal and a plurality of predetermined delay values; the original synchronization control signal having a pulse that is related to refreshing of image frames on the scan-type display, and that corresponds to the adjustment data in time; and a backlight driver coupled to said controller to receive the adjustment data, the original synchronization control signal and the predetermined delay values, and adapted to be further coupled to the backlight source;

said backlight driver generating an internal synchronization control signal based on the original synchronization control signal and the predetermined delay values; the internal synchronization control signal having a plurality of pulses that correspond to the adjustment data in time; a time delay of each of the pulses of the internal synchronization control signal with respect to the pulse of the original synchronization control signal being dependent on a respective one of the predetermined delay values;

said backlight driver further generating a backlight driving output based on the adjustment data and the internal synchronization control signal and outputting the backlight driving output to the backlight source, such that each of the light emitting elements of the backlight source emits light intermittently, and brightness of each of the areas of the backlight source changes to be dependent on the adjustment data upon appearance of a respective one of the pulses of the internal synchronization control signal;

wherein the pulse of the original synchronization control signal appears after the adjustment data is generated; and wherein a time interval between the pulse of the original synchronization control signal and each of the pulses of the internal synchronization control signal is determined by the respective one of the predetermined delay values.

6. The backlight driving device of claim 5, wherein:

a total number of the predetermined delay values is no less than two; and the predetermined delay values form an arithmetic progression with a positive common difference.

7. The backlight driving device of claim 5, wherein:

a total number of the predetermined delay values is no less than two;

the predetermined delay values form a strictly monotonically increasing sequence; and differences, between each two adjacent ones of the predetermined delay values, are different from one another.

8. The backlight driving device of claim 5, wherein a first one of the predetermined delay values is zero.

* * * * *